US010837225B2

(12) United States Patent
Lammes et al.

(10) Patent No.: US 10,837,225 B2
(45) Date of Patent: Nov. 17, 2020

(54) REVOLVING DOOR

(71) Applicant: Royal Boon Edam International B.V., Edam (NL)

(72) Inventors: Hendrik Lammes, Edam (NL); Melvin Jarno van der Molen, Schagen (NL); Gertjan Otto, Purmerend (NL)

(73) Assignee: ROYAL BOON EDAM INTERNATIONAL B.V., Edam (NL)

( * ) Notice: Subject to any disclaimer, the term of this patent is extended or adjusted under 35 U.S.C. 154(b) by 10 days.

(21) Appl. No.: 16/121,306

(22) Filed: Sep. 4, 2018

(65) Prior Publication Data

US 2018/0371828 A1 Dec. 27, 2018

Related U.S. Application Data

(63) Continuation of application No. PCT/NL2017/050125, filed on Mar. 1, 2017.

(30) Foreign Application Priority Data

Mar. 2, 2016 (NL) ..... 2016353

(51) Int. Cl.
*E06B 3/90* (2006.01)
*E05F 15/73* (2015.01)
*E06B 3/50* (2006.01)

(52) U.S. Cl.
CPC ..... *E06B 3/90* (2013.01); *E05F 15/73* (2015.01); *E06B 3/5054* (2013.01); *E05Y 2900/132* (2013.01)

(58) Field of Classification Search
None
See application file for complete search history.

(56) References Cited

U.S. PATENT DOCUMENTS 798,786 A 9/1905 Hansen
1,024,797 A * 4/1912 Malocsay ..... E06B 3/90 49/42

(Continued)

FOREIGN PATENT DOCUMENTS

DE 9208898 U1 * 4/1993 ..... E06B 3/90
DE 4211861 10/1993

(Continued)

*Primary Examiner* — Marcus Menezes
(74) *Attorney, Agent, or Firm* — Peacock Law P.C.; Janeen Vilven; Justin Muehlmeyer

(57) ABSTRACT

A revolving door comprising a wall or walls in which openings for inlet and outlet of persons and/or objects are provided, and rotatable door wings that during use are rotatable around an imaginary central vertical axis in a passage area surrounded by the wall or walls, wherein each of said door wings is provided with a slidable door wing part for extending and/or retracting the door wing of which it forms a part, wherein each of said door wings substantially comprises slidable door wing parts only so as to provide that the slidable door wing parts of any single door wing are selectable to be placed in at least two positions, a first position wherein said door wing parts are entirely adjacent or next to each other and wherein edges of said door wing parts are adjacent to the wall or walls, and wherein said door wing parts extend radially away from said wall or walls towards the imaginary central vertical axis, and a second position wherein said door wing parts are entirely adjacent or next open opening or to each other and wherein edges of said door wing parts are adjacent to the central vertical axis, and wherein said door wing parts extend radially away from the central vertical axis towards the wall or walls.

8 Claims, 12 Drawing Sheets

(56) References Cited

U.S. PATENT DOCUMENTS

| | | | | |
|---|---|---|---|---|
| 1,184,725 | A | 5/1916 | Dawes | |
| 1,417,372 | A * | 5/1922 | Friedland | E06B 3/90 49/42 |
| 2,081,774 | A * | 5/1937 | Shields | E06B 3/90 49/44 |
| 3,726,044 | A | 4/1973 | Economou | |
| 4,341,165 | A * | 7/1982 | Calandritti | E05G 5/003 109/8 |
| 5,634,295 | A * | 6/1997 | Bunzl | E06B 3/90 49/44 |
| 6,367,198 | B1 * | 4/2002 | Rockenbach | E06B 3/90 49/42 |
| 6,370,822 | B1 | 4/2002 | Otto | |
| 2009/0031632 | A1 | 2/2009 | Wang | |
| 2009/0293362 | A1 * | 12/2009 | Wang | E05D 15/48 49/45 |
| 2010/0050525 | A1 * | 3/2010 | Blasi | E06B 3/90 49/26 |
| 2019/0063131 | A1 * | 2/2019 | Lammes | E05D 15/02 |

FOREIGN PATENT DOCUMENTS

| | | | | |
|---|---|---|---|---|
| DE | 4211861 | A1 * | 10/1993 | E06B 3/90 |
| DE | 19905473 | C1 * | 1/2001 | E06B 3/903 |
| EP | 0296134 | | 12/1988 | |
| EP | 0296134 | A1 * | 12/1988 | E06B 3/90 |
| EP | 0606193 | | 7/1994 | |
| EP | 0715049 | | 6/1996 | |
| EP | 2236716 | | 10/2010 | |
| FR | 2373664 | | 7/1978 | |
| JP | 2007070437 | | 3/2002 | |
| JP | 2010001735 | | 1/2010 | |
| NL | 9302235 | A * | 7/1995 | E06B 3/90 |
| WO | 97/25509 | | 7/1997 | |
| WO | 02/10543 | | 2/2002 | |
| WO | 2017/150974 | | 9/2017 | |
| WO | 2017/188810 | | 11/2017 | |
| WO | 2018/208148 | | 11/2018 | |

* cited by examiner

REVOLVING DOOR

CROSS-REFERENCE TO RELATED APPLICATIONS

This application is a continuation of International Application No. PCT/NL2017/050125 filed on Mar. 1, 2017, which claims priority to Dutch Application 2016353 filed Mar. 2, 2016 and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIALS SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to a revolving door comprising a wall or walls in which openings for inlet and outlet of persons and/or objects are provided, and comprising rotatable door wings that during use are rotatable around an imaginary central vertical axis in a passage area surrounded by the wall or walls, wherein each of said door wings is provided with a slidable door wing part for extending and/or retracting the door wing of which it forms a part.

Description of Related Art Including Information Disclosed Under 37 C.F.R. §§ 1.97 and 1.98

Such a revolving door is known since the early 90s of the previous century. Both U.S. Pat. No. 5,634,295 and EP 0 715 049 teach a revolving door with door wings of the telescopic type, wherein each door wing has a slidable door wing part that is movable into a casing of the door wing, wherein the casing extends radially from the wall in the direction of the imaginary central vertical axis. When the slidable door wing parts are moved into their respective casings a middle part of the passage area between the walls is freed or can be freed from any hindrance by pivoting away the casings, as required in cases of panic to provide an unhindered flea way.

DE 42 11 861 teaches another revolving door with door wings of the telescopic type, wherein each door wing has a slidable door wing part that is movable into a casing of the door wing, wherein the casing extends radially from the imaginary central vertical axis towards the wall or walls. The slidable door wing parts that move along the wall or walls are retracted when they pass the opening or openings in order to prevent pinching of a person or a person's finger between the door wing and the edge of the opening in the wall or walls.

BRIEF SUMMARY OF THE INVENTION

An embodiment of the present invention relates to a revolving door with a wall or a plurality of walls in which a plurality of openings for inlet and outlet of one or more persons and/or objects can be provided. Furthermore, a plurality of rotatable door wings that during use are rotatable around an imaginary central vertical axis in a passage area surrounded by the wall or the plurality of walls can be provided, wherein each of the plurality of rotatable door wings can have a slidable door wing part for extending and/or retracting the door wing of which it forms a part. Each of the plurality of rotatable door wings can have a plurality of slidable door wing parts. The plurality of slidable door wing parts of any single door wing can be selectable to be placed in at least two positions. There can be a first position wherein the plurality of slidable door wing parts can be entirely adjacent or next to each other. A plurality of edges of the plurality of slidable door wing parts can be adjacent to the wall or the plurality of walls, and the plurality of slidable door wing parts extend radially away from the wall or plurality of walls towards the imaginary central vertical axis. An embodiment of the present invention can further contain a second position with the plurality of slidable door wing parts entirely adjacent or next to each other and wherein a plurality of edges of the plurality of slidable door wing parts can be adjacent to the central vertical axis. The plurality of slidable door wing parts extend radially away from the imaginary central vertical axis towards the wall or the plurality of walls.

In an embodiment of the present invention, the plurality of slidable door wing parts of any single door wing can be radially movable back-and-forth past the imaginary central vertical axis between opposite positions relative to the imaginary central vertical axis.

In another embodiment of the present invention, the plurality of slidable door wing parts of any single door wing can be placed next to each other or substantially in each other's extended direction or in any intermediate relative position with respect to each other. Each single slidable door wing part of any single door wing can be positioned either closer to the wall than to the central vertical axis, or closer to the imaginary central vertical axis than to the wall.

In another embodiment of the present invention, during use of the revolving door, the plurality of rotatable door wings can substantially extend from the imaginary central vertical axis up to the wall or the plurality of walls. A slidable door wing part of a door wing can approach an opening or, when the plurality of rotatable door wings are stationary, a slidable door wing part of a door wing that is near to an opening, can be arranged to retract away from the wall to give way from the passage area to the opening.

In another embodiment of the present invention, during use of the revolving door, when the plurality of rotatable door wings rotate, the plurality of slidable door wing parts of each door wing can be capable of simultaneously retracting away from the wall or plurality of walls.

In another embodiment of the present invention, the revolving door can have a first sensor means, wherein the rotation of the door wings can be interruptible depending on the first sensor means. Selected door wings of the revolving door can be arranged to define a confined area delimited by the wall wherein access to or leaving the confined area can be prevented. A door wing part of at least one of the door wings is operational to provide a conventional sliding door to enable passing the passage area.

In another embodiment of the present invention, a revolving door can have a night door or a plurality of night doors to close off the opening or the plurality of openings. The plurality of edges of the plurality of slidable door wing parts of the plurality of rotatable door wings can be positioned against the night door or the plurality of night doors to support the night door or the plurality of night doors against the force of wind and against the forces of breaking and entry.

In another embodiment of the present invention, when the revolving door has the plurality of door wings stationary, the plurality of edges of the plurality of slidable door wing parts of the plurality of rotatable door wings can be intimately positioned against the wall or the plurality of walls to promote its draught resistance.

In another embodiment of the present invention, the passage area can be provided with a second sensor means and wherein during use when the plurality of rotatable door wings substantially extends from the imaginary central vertical axis up to the wall or the plurality of walls, the slidable door wing part of the plurality of door wings that threatens to be obstructed by a passant in the passage area as observed by the second sensor means can be arranged to retract away from the wall so as to move past the passant and to resume its original relative position with reference to the remainder of the door wing after the door wing is completely passed and the passant is observed by the second sensor means.

It is an object of the invention to provide a revolving door of improved versatility and flexibility in use. It is another object of the invention to provide a revolving door which can be attuned also after its placement to the momentary needs existing where the revolving door is erected, which needs may vary during the day. It is another object of the invention to provide a revolving door which is usable both as a security door, and as a door that enables quickly passing of a high number of people. It is still another object of the invention to provide a revolving door meeting high-security demands and resistance against breaking and entry. It is still another object of the invention to improve the door's resistance against draught.

To promote these objects and to acquire other advantages that will become apparent from the following disclosure, the revolving door of the invention has the features of one or more of the appended claims. It is expressly noted that the features that are mentioned in the claims can be applied independent from each other or in a cumulative way in order to face the demands of the situation.

In a first aspect of the revolving door of the invention each of its door wings substantially comprises slidable door wing parts only, so as to provide that the slidable door wing parts of any single door wing are selectable to be placed in at least two positions, a first position wherein said door wing parts are entirely adjacent or next to each other and wherein edges of said door wing parts are adjacent to the wall or walls, and wherein said door wing parts extend radially away from said wall or walls towards the central vertical axis, and a second position wherein said door wing parts are entirely adjacent or next to each other and wherein edges of said door wing parts are adjacent to the central vertical axis, and wherein said door wing parts extend radially away from the central vertical axis towards the wall or walls. With this construction the door of the invention is provided with tremendous versatility and offers its user a large amount of flexibility and various possible uses of the door. Several examples of that will be provided hereinafter with reference to the drawing of multiple operational uses of the door of the invention.

Preferably the slidable door wing parts of any door wing are radially movable back-and-forth past the imaginary central vertical axis between opposite positions relative to said imaginary central vertical axis. As already mentioned above in general, this feature can be applied in addition to or independently from the feature in the previous paragraph.

To further promote the door's flexibility the slidable door wing parts of any door wing are at all times placeable next or adjacent to each other, or essentially in each other's extended direction, or in any intermediate relative position with respect to each other. It is also a preferred feature according to the invention that each single slidable door wing part of any door wing is positionable either closer to the wall than to the central vertical axis, or closer to the central vertical axis than to the wall. This further contributes to the high flexibility of the door of the invention.

It is further preferred that during use wherein essentially the door wings extend from the imaginary central vertical axis up to the wall or walls, a slidable door wing part of a door wing that approaches an opening or, when the door wings are stationary, that is near to an opening, retracts away from the wall to give way from the passage area delimited by the walls towards the opening. A swift passing of the revolving door is then possible, also in case the door is otherwise restricted from moving.

One other nice feature of the revolving door of the invention is that it is arranged that during use when the door wings rotate, the slidable door wing parts of each door wing are simultaneously retractable away from the wall or walls. The eventual completely retracted position of the slidable door wing parts corresponds to the situation in which the revolving door has come to a full stop and remains stationary, wherein passage of the door is then enabled by reason of the retracted slidable door wing parts. The simultaneous retraction of the door wing parts during rotation of the door wings makes a quick conversion possible from a conventional use of the revolving door wherein it rotates, to the situation that the door is stationary and passing of the door is only enabled by the retracted slidable door wing parts.

Another possible use of the revolving door of the invention occurs when the door is provided with first sensor means, and further is equipped with the feature that rotation of the door wings is interruptible depending on the first sensor means, wherein selected door wings of the door define a confined area delimited by the wall and wherein access to or leaving said confined area is prevented, and wherein the door wing parts of at least one of the remaining door wings are operational to provide a conventional sliding door to enable passing the passage area independent from the time that is required for scrutinizing or investigating the person or object in the confined area. Rotation of the revolving door and the other persons are therefore not obstructed in case there is something that otherwise would prevent the revolving door from continuing its rotation.

Yet another preferred and beneficial feature of the revolving door of the invention is that the passage area is provided with second sensor means and that during use wherein essentially the door wings extend from the central vertical axis up to the wall or walls, a slidable door wing part of a door wing that threatens to be obstructed by a passant in the passage area as observed by the second sensor means, is arranged to retract away from the wall so as to move past said passant and to resume its original relative position with reference to the remainder of the door wing after said door wing is completely passed said passant as observed by said second sensor means.

Another beneficial feature is that when the revolving door has a night door or night doors to close off the openings, it is preferable that edges of the slidable door wing parts of the door wings are positionable against the night door or night doors to support said door or doors against the force of wind and/or against the forces of breaking and entry.

Yet another preferred feature of the door of the invention is that during standstill of the revolving door edges of the slidable door wing parts of the door wings are intimately positionable against the wall or walls to provide very effective draught resistance.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
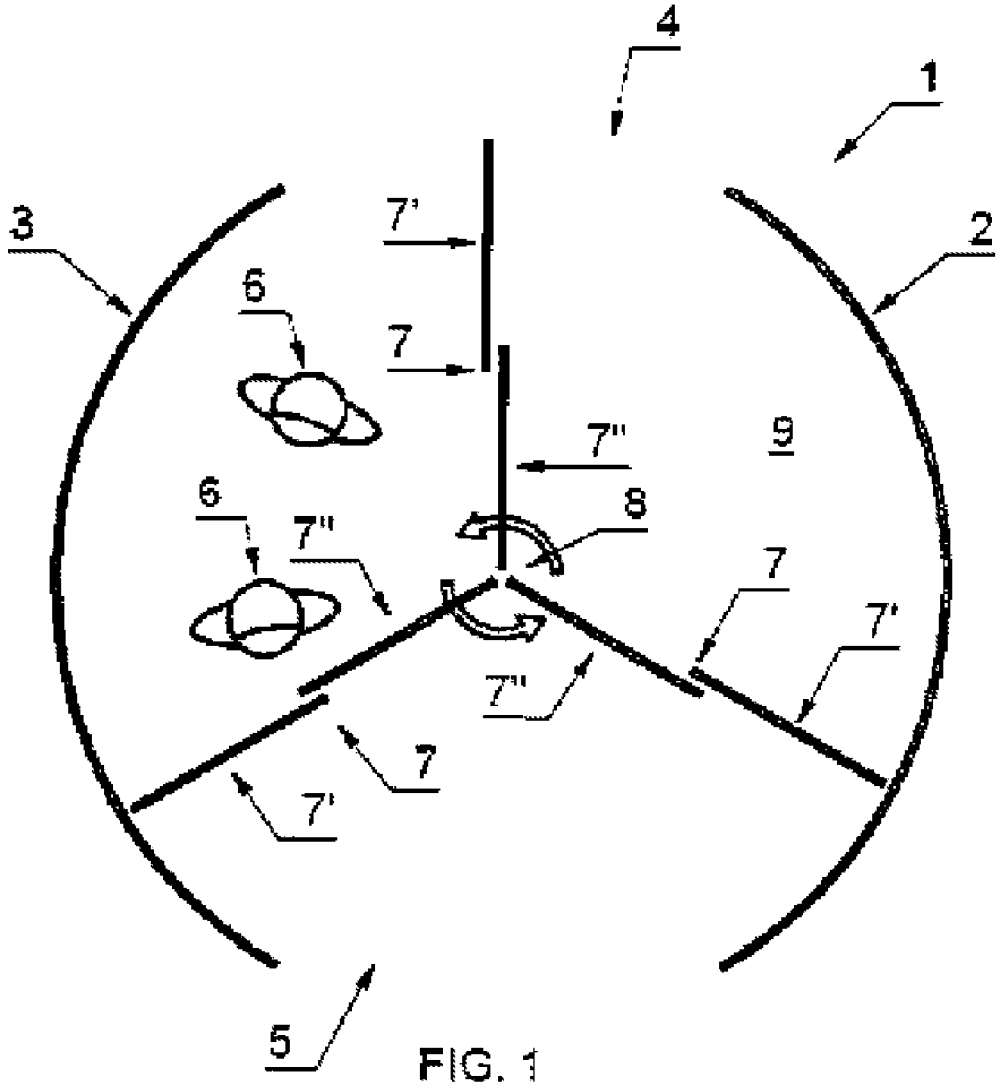
FIG. 1 illustrates a first view of a revolving door according to one embodiment of the present invention.

Making first reference to FIG. 1, a revolving door 1 is shown comprising a wall or walls 2, 3 in which openings 4, 5 for inlet and outlet of persons 6 and/or objects are provided. The door 1 has rotatable door wings 7 that during use are rotatable around an imaginary central vertical axis 8 in a passage area 9 surrounded by the wall or walls 2, 3. An embodiment of the present invention includes that each of said door wings 7 is provided with a slidable door wing part for extending and/or retracting the door wing 7 of which it forms a part. This feature is per se known from U.S. Pat. No. 5,634,295; EP 0 715 049 and DE 42 11 861.

Figure 2A:
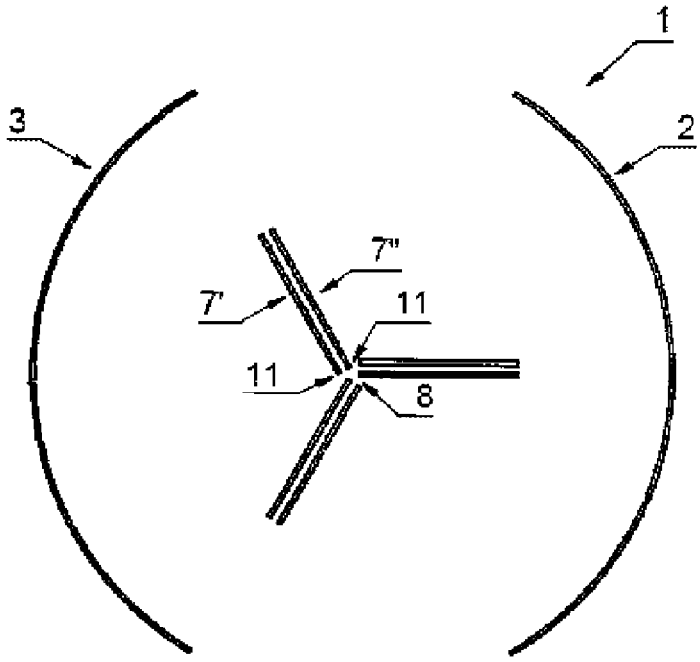
FIG. 2A illustrates a second position for door ring parts.
Figure 2B:
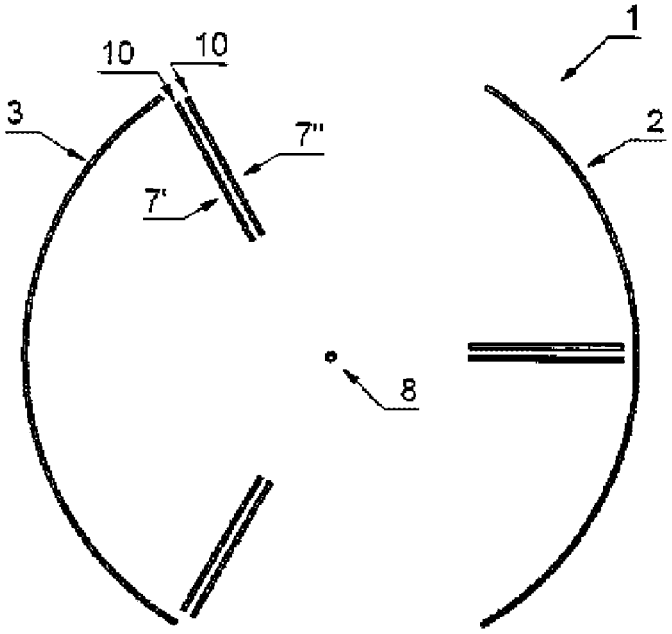
FIG. 2B illustrates a first position for door ring parts.

According to the invention each of said door wings 7 substantially comprises slidable door wing parts 7', 7" therewith avoiding fixed door wing parts (casings) as are known from the mentioned prior art and providing that the slidable door wing parts 7', 7" of any single door wing 7 are selectable to be placed in at least two positions as shown in FIG. 2A and FIG. 2B. FIG. 2B shows a first position wherein said door wing parts 7', 7" are entirely adjacent or next to each other and wherein edges 10 of said door wing parts 7', 7" are adjacent to the wall or walls 2, 3, and wherein said door wing parts 7', 7" extend radially away from said wall or walls 2, 3 towards the imaginary central vertical axis 8 (the figure shows a dot, but this is imaginary since actually there is a void). FIG. 2A shows a second position wherein said door wing parts 7', 7" are entirely adjacent or next to each other and wherein edges 11 of said door wing parts 7', 7" are adjacent to the imaginary central vertical axis 8, and wherein said door wing parts 7', 7" extend radially away from the central vertical axis 8 towards the wall or walls 2, 3.

Figure 3:
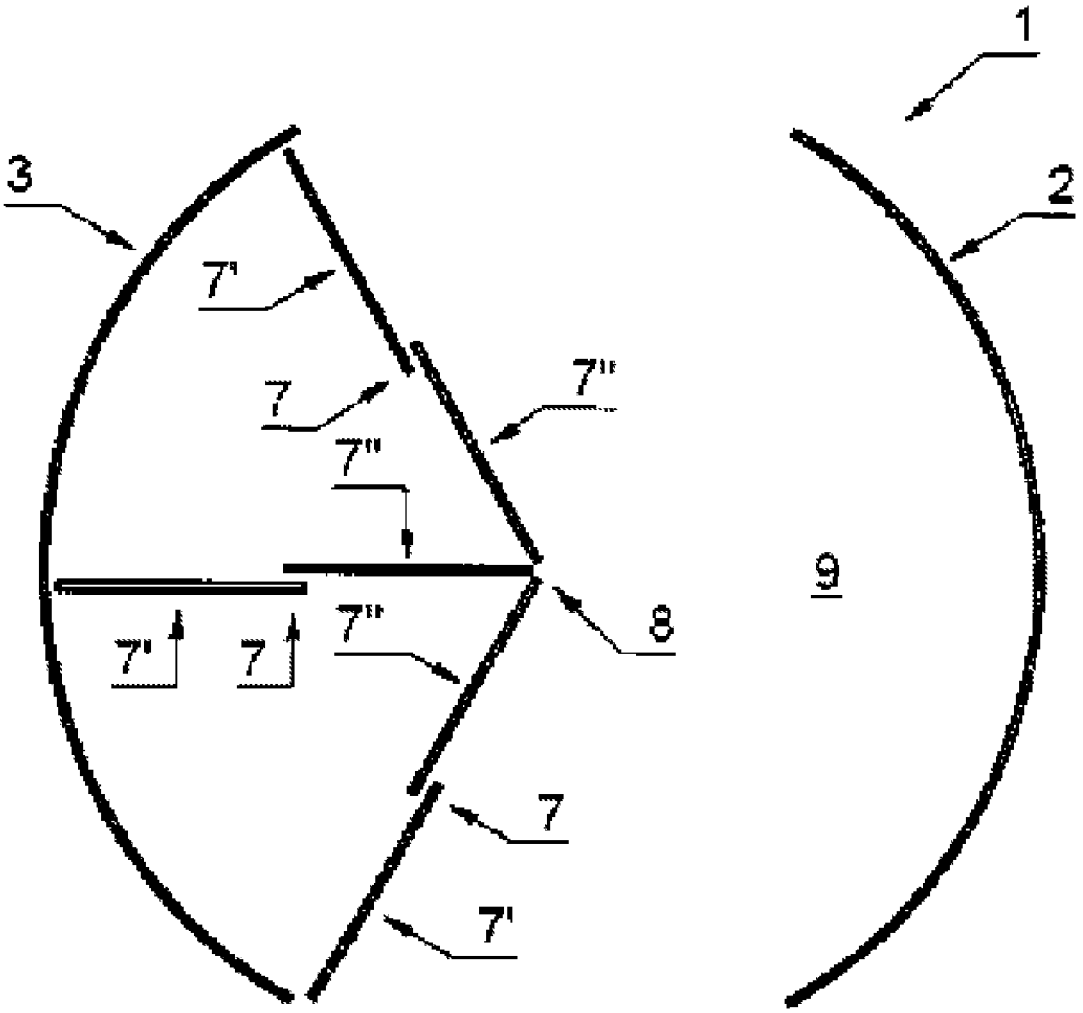
FIG. 3 illustrates a first embodiment of the revolving door.
Figure 4:
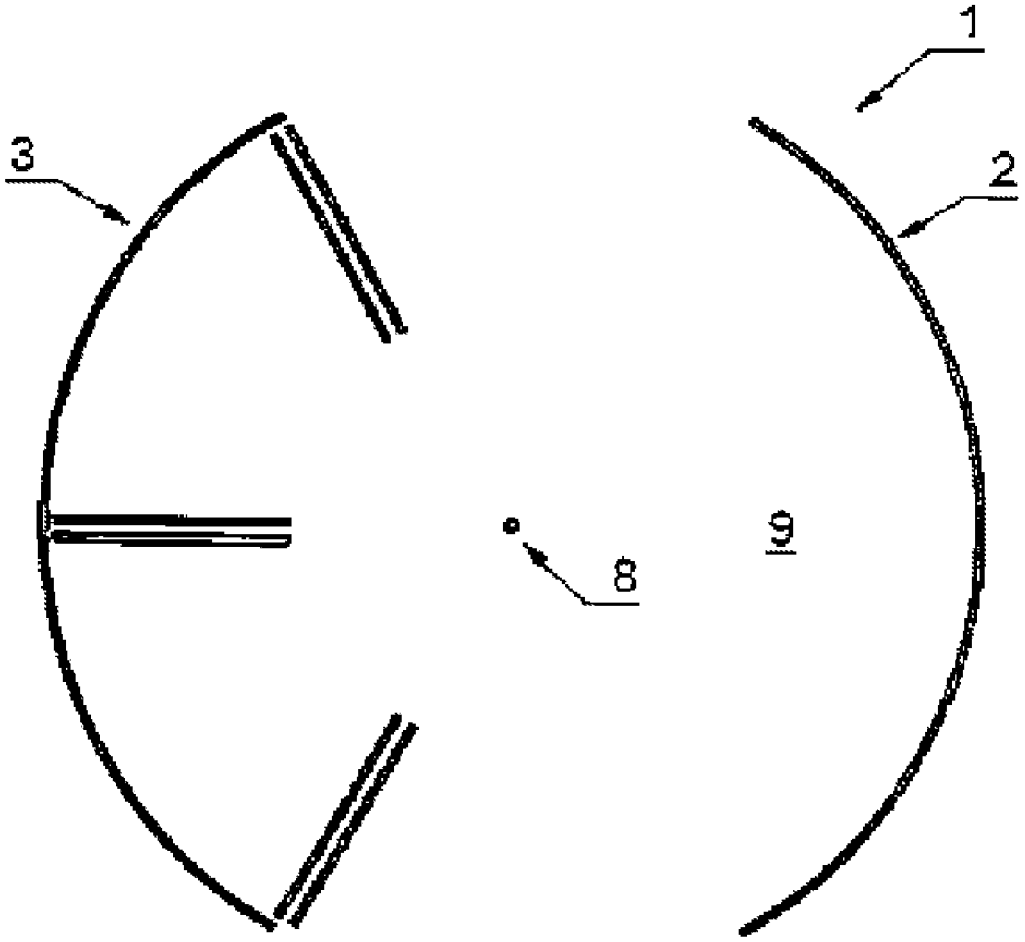
FIG. 4 illustrates a second embodiment of the revolving door.
Figure 5:
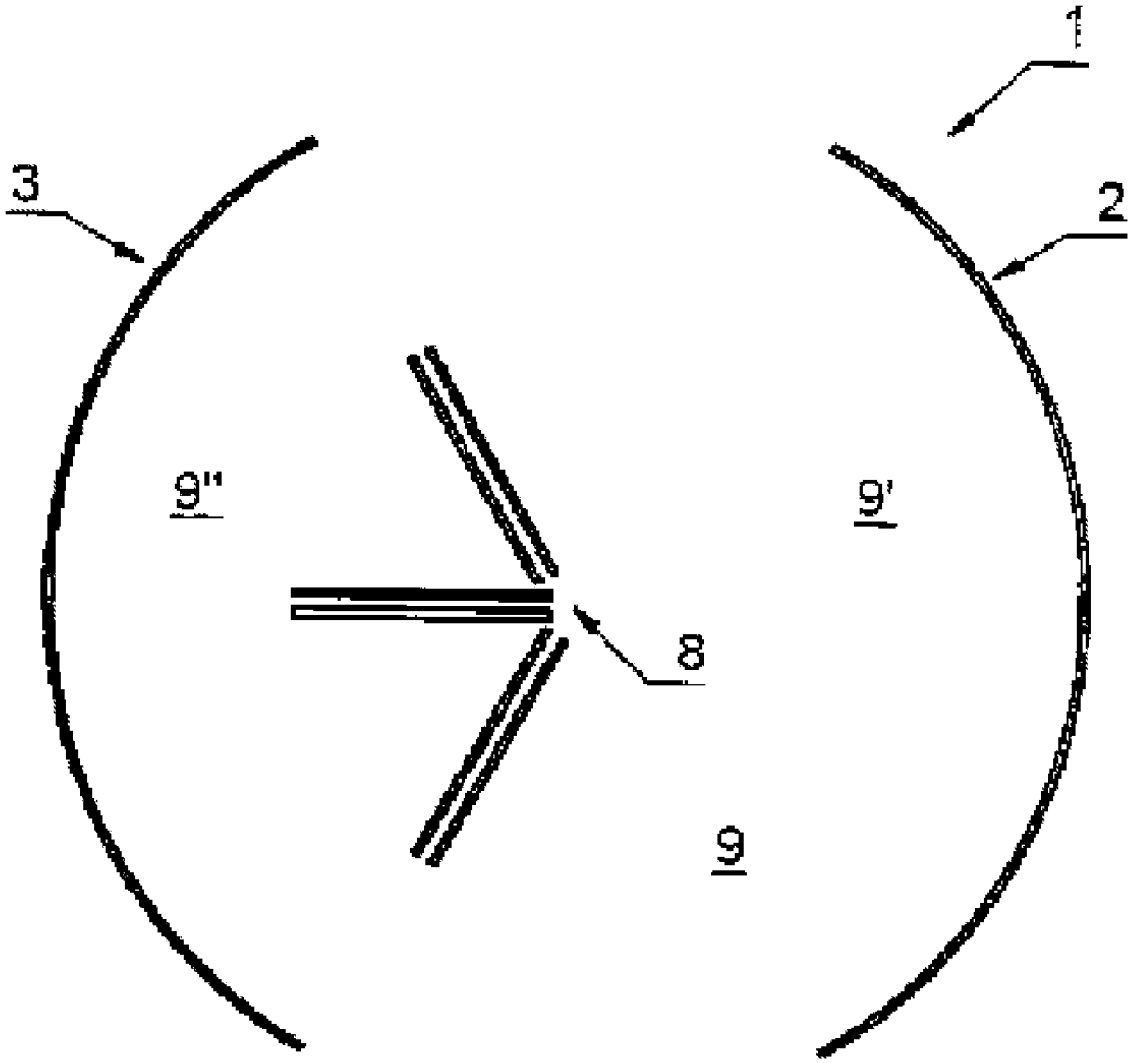
FIG. 5 illustrates a third embodiment of the revolving door.

FIGS. 3, 4 and 5 show three different embodiments of the revolving door 1 of the invention which are all made possible by the feature that the slidable door wing parts 7', 7" of any door wing 7 are radially movable back-and-forth past the imaginary central vertical axis 8 between opposite positions relative to said imaginary central vertical axis 8. This means that all door wings 7 of the door 1 according to the invention can be positioned at the same side of the door with reference to the imaginary central vertical axis 8 as shown in FIGS. 3, 4 and 5. In fact this feature is applicable as FIG. 3 shows, independent from whether the slidable wing parts 7', 7" are positioned next or adjacent to each other as explained hereinabove with reference to FIGS. 2A and 2B. The slidable wing parts 7', 7" can also be placed in each other's extended direction according to FIG. 3.

On the other hand, FIG. 4 and FIG. 5 show the situation that the slidable wing parts 7', 7" are together closer to a wall 3 than to the imaginary central axis 8 (FIG. 4) or are closer to the imaginary central axis 8 then to the wall 3 (FIG. 5). This latter option is beneficial for when two streams of people are moving in opposite directions, wherein a larger part 9' of the passage space 9 can be reserved for the higher amount of people passing per unit of time, and the smaller part 9" of the passage space 9 can be available for the lower amount of people that are passing the door 1 per unit of time.

Figure 6:
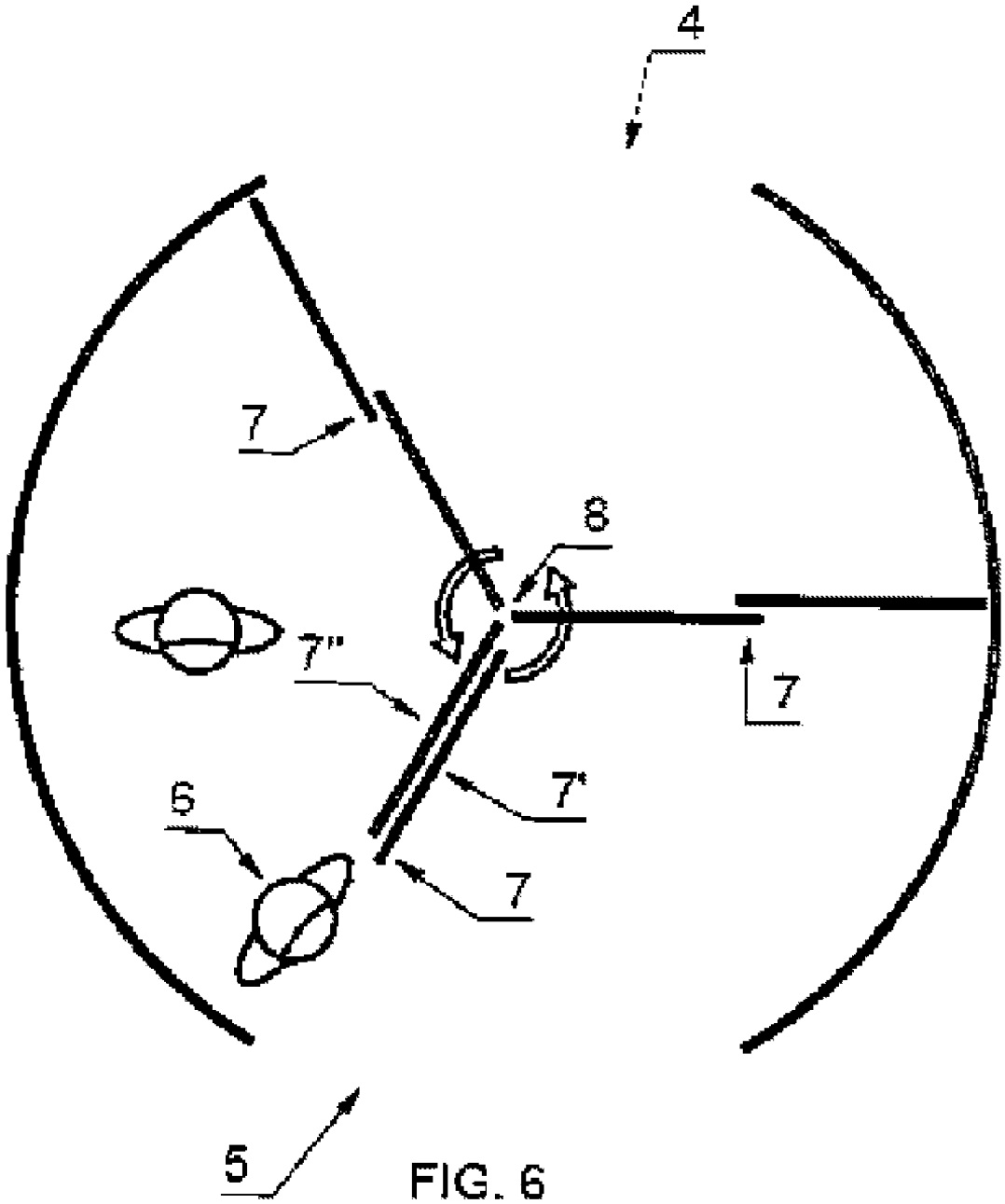
FIG. 6 illustrates regular use of the door.
Figure 7:
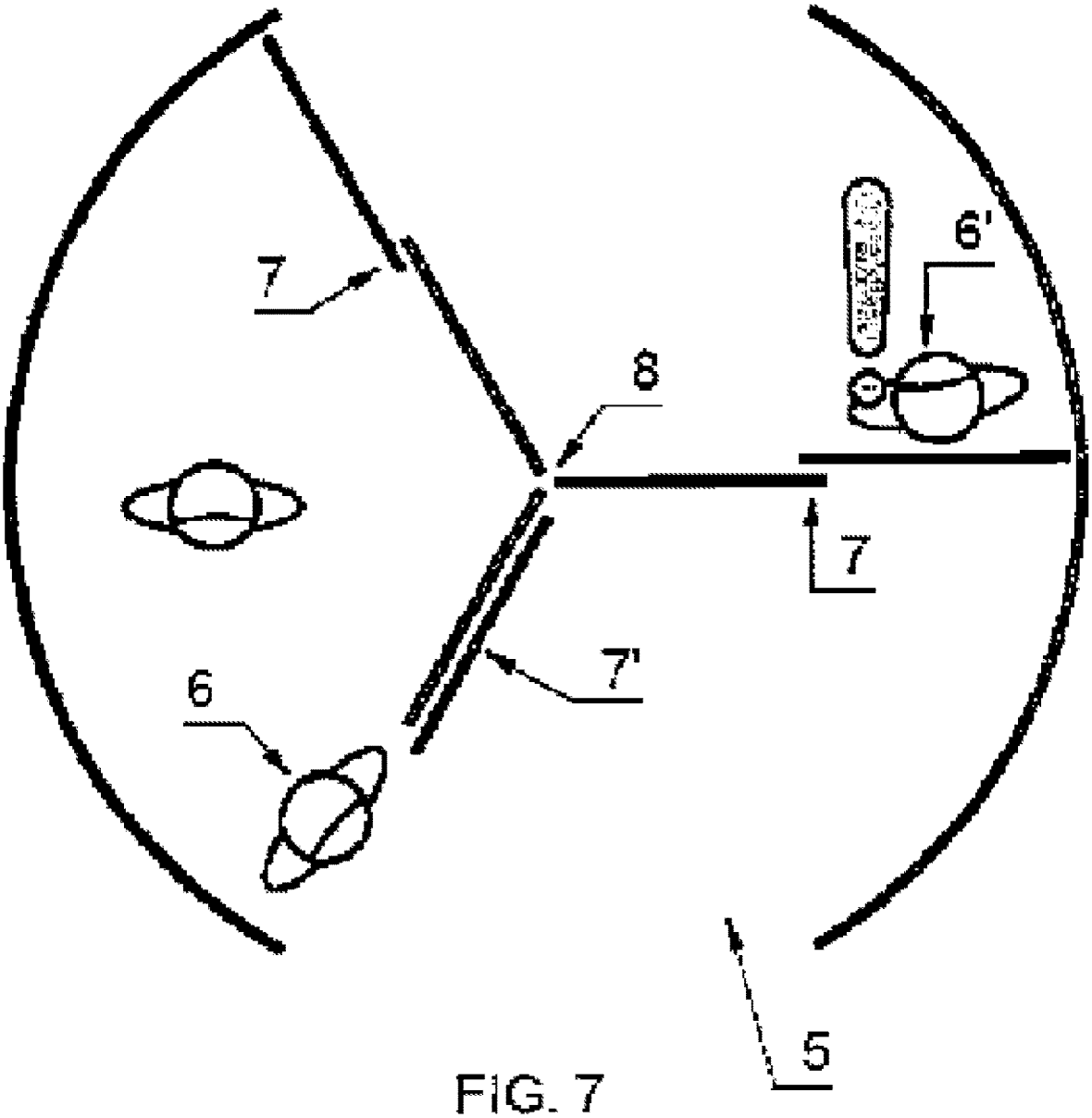
FIG. 7 illustrates a person blocking the door.

The slidable door wing parts 7', 7" of any door wing 7 are at all times placeable next to each other or essentially in each other's extended direction or in any intermediate relative position with respect to each other, and each single slidable door wing part 7', 7" of any door wing 7 is positionable either closer to the wall 2, 3 than to the imaginary central vertical axis 8, or closer to the imaginary central vertical axis 8 than to the wall 2, 3. This enables that during regular use of the door 1 of the invention as shown in FIG. 6, wherein during the larger part of the rotational movement of the door wings, said door wings 7 extend from the central vertical axis 8 up to the wall or walls 2, 3, the door wings 7 are arranged such that a slidable door wing part 7' of a door wing 7 that approaches an opening 5 gives way to a person 6 from the passage area 9 to the opening 5. This enables that the person 6 can earlier leave the passage area 9 without having to wait until the concerning door wing 7 has progressed far enough beyond the concerning edge of the opening 5. It is also possible that when rotation of the revolving door 1 has stopped and the door wings 7 are stationary, which may be caused for instance by another person 6' blocking the door as is shown in FIG. 7, that the door wing part 7' that is near to an opening 5, is arranged to retract away from the wall 3 to give way to the first mentioned person 6 from the passage area 9 to the opening 5.

FIGS. 8A-8D relate to a sequence of situations wherein during use when the door wings rotate 7 as shown in FIG.

Figure 8A:
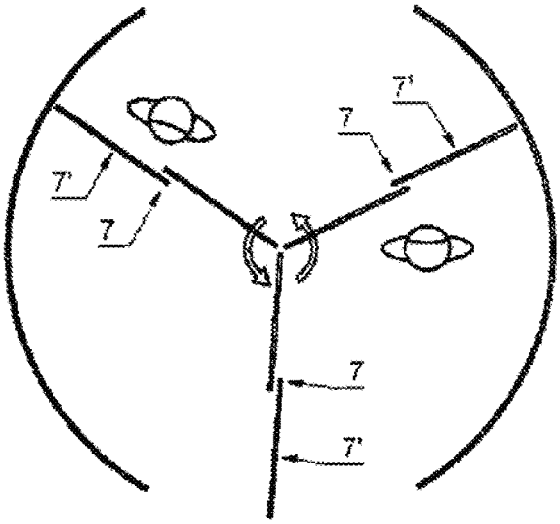
FIG. 8A-8D illustrate a sequence of situations of door rotations during use.
Figure 8B:
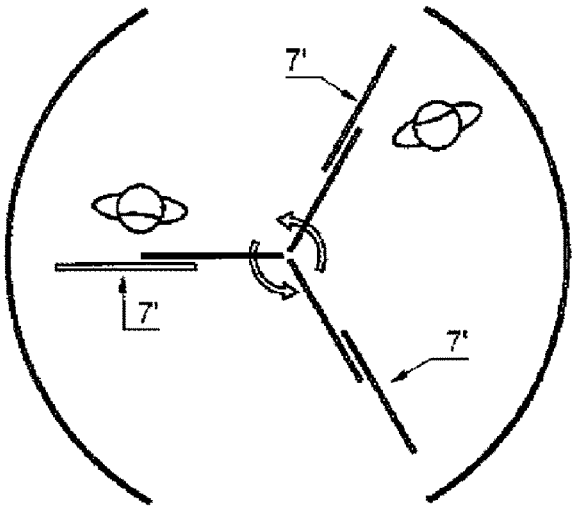
Figure 8C:
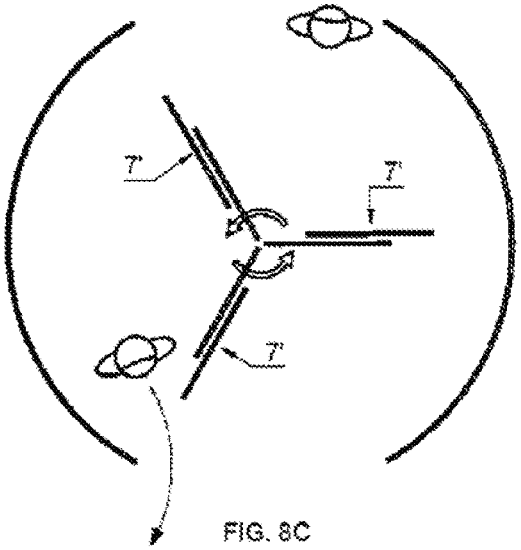
Figure 8D:
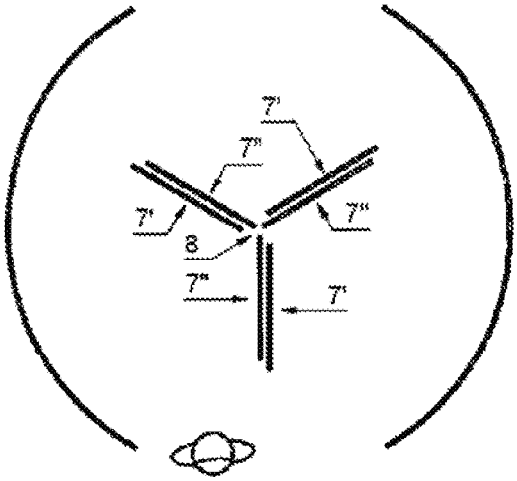

8A, the slidable door wing parts 7' of each door wing 7 are simultaneously and progressively retracted away from the wall or walls 2, 3 as illustrated in FIGS. 8B-8D. This provides for a dynamic conversion from a regular operation of the revolving door 1 of the invention wherein the door wings rotate as shown in FIG. 8A and also depicted in FIG. 1 to a stationary positioning of the slidable door wing parts 7', 7" close to the imaginary vertical axis 8 of the door, which is shown in FIG. 8D and also depicted in FIG. 2A.

Figure 9A:
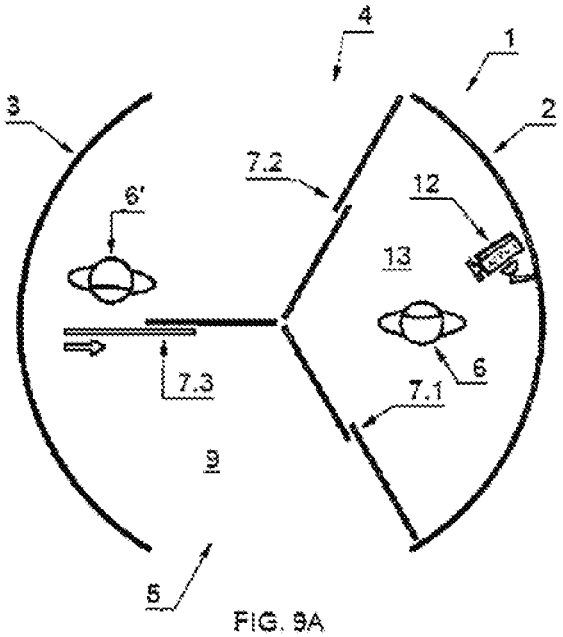
FIG. 9A-9C illustrate use of the revolving door as a security door.
Figure 9B:
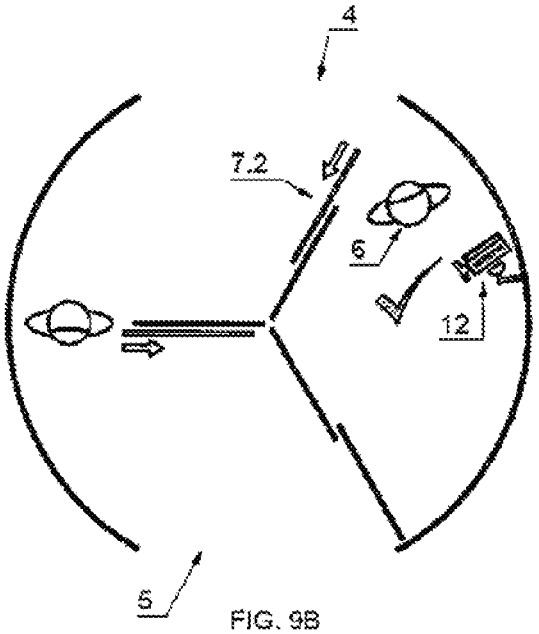
Figure 9C:
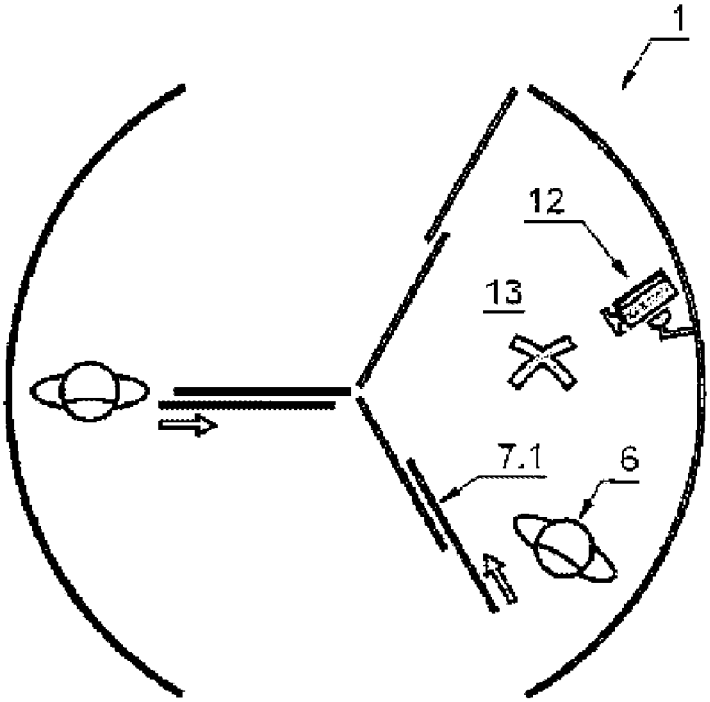

Use of the revolving door 1 of the invention as security door is shown with reference to FIGS. 9A-9C. The revolving door 1 is provided with first sensor means 12, for instance a camera. The revolving door is arranged such that rotation of the door wings 7 is interruptible depending on the first sensor means 12. In FIG. 9A a person 6 is monitored and denied access to the building that the revolving door 1 provides access to. In that situation rotation of the door wings 7 is interrupted and depending on the rotational position of the door wings 7, selected door wings 7.1 and 7.2 of the door 1 are arranged to define a confined area 13 delimited by the wall 2 wherein access to or leaving said confined area 13 is prevented. Person 6 can be kept secured in the confined area 13 to wait for appropriate authorities who can take further care of this person. At the same time and whilst the confined area 13 is kept secured, a door wing part of at least one of the remaining door wings 7.3 can be maintained operational as a conventional sliding door to enable another person 6' passing the passage area. FIG. 9B shows a situation where the person 6 is granted access, and a movable door wing part of door wing 7.2 is retracted to give way to person 6 towards opening 4. In FIG. 9C another situation is shown wherein person 6 is denied access again. In that situation leaving the confined area 13 is made possible at the side where the person 6 originally came in by retracting a movable wing part of sliding door 7.1, to enable that the person 6 leaves the confined area 13 yet is denied access to the building where the revolving door 1 is placed.

Figure 11A:
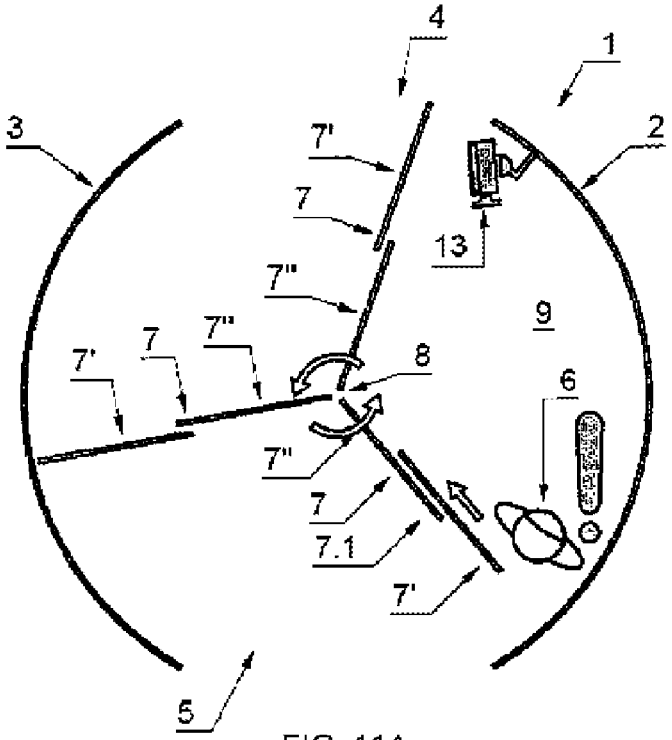
FIG. 11A-B illustrate a fourth embodiment of the revolving door.
Figure 11B:
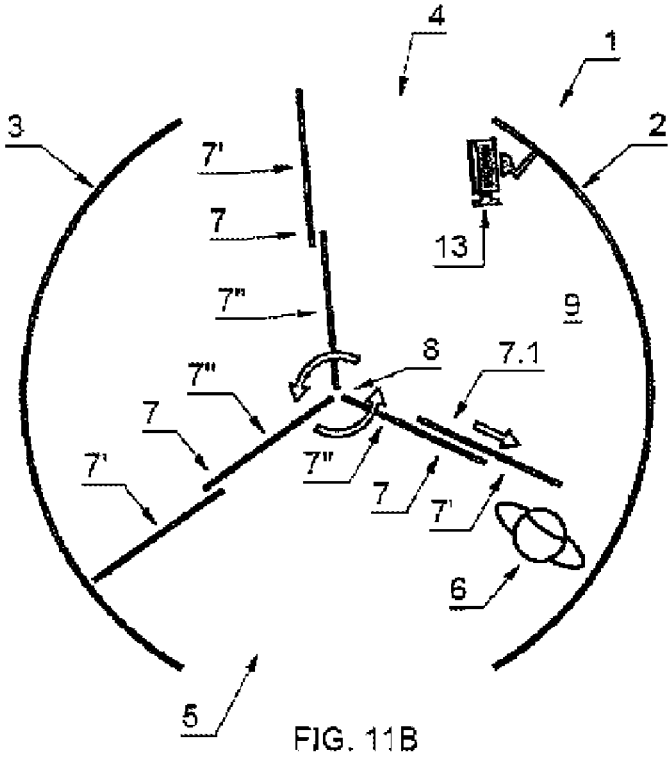

FIGS. 11A and 11B show an option of the revolving door of the invention wherein the door is prevented from being obstructed by a still standing person 6. For that purpose the door is provided with the features that the passage area 9 is provided with second sensor means 13, for instance a camera, and that during use wherein essentially the door wings 7 extend from the central vertical axis 8 up to the wall or walls 2, a slidable door wing part 7' of a door wing 7.1 that threatens to be obstructed by said still standing person 6 in the passage area 9 as observed by the second sensor means 13, is arranged to retract away from the wall 2 so as to move past said still standing person 6 as shown in FIG. 11A. FIG. 11B shows the slidable door wing part 7' of door wing 7.1 returning to its original relative position with reference to the remainder of the door wing 7 after said door wing is completely past said still standing person 6 as observed by said second sensor means 13.

Figure 10:
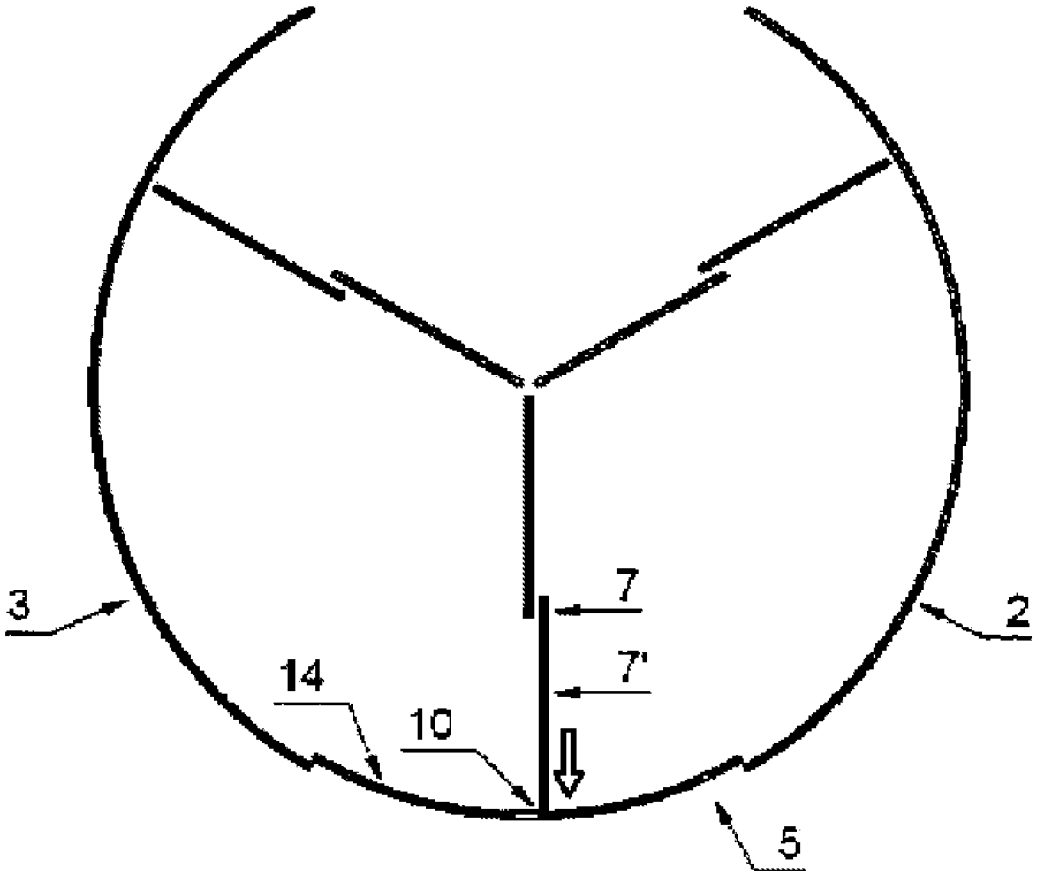
FIG. 10 illustrates the door prevented from being obstructed by a still standing person.

FIG. 10 finally shows an embodiment of the revolving door 1 of the invention provided with a night door 14 to close off the opening 5, wherein an edge 10 of a slidable door wing part 7' of the door wing 7 is positionable against the night door 14 to support said door against the force of wind and/or against the forces of breaking and entry. Comparably but for a different purpose, the edges 10 of the slidable door wing parts 7' of the door wings 7 can also be arranged to be intimately positionable against the wall or walls 2, 3 to provide optimal draught resistance at the time the door wings 7 have ceased rotating and are stationary.

Although the invention has been discussed in the foregoing with reference to several exemplary embodiments of the revolving door of the invention, the invention is not restricted to these particular embodiments which can further be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to the exemplary embodiments. The scope of protection of the invention shall therefore be construed in accordance with the appended claims only, wherein a possible ambiguity in the wording of the claims shall be resolved using the exemplary embodiments.

In the preferred embodiment, and as readily understood by one of ordinary skill in the art, the apparatus according to the invention will include a general or specific purpose computer or distributed system programmed with computer software implementing the steps described above, which computer software may be in any appropriate computer language, including C++, FORTRAN, BASIC, Java, assembly language, microcode, distributed programming languages, etc. The apparatus may also include a plurality of such computers/distributed systems (e.g., connected over the Internet and/or one or more intranets) in a variety of hardware implementations. For example, data processing can be performed by an appropriately programmed microprocessor, computing cloud, Application Specific Integrated Circuit (ASIC), Field Programmable Gate Array (FPGA), or the like, in conjunction with appropriate memory, network, and bus elements.

What is claimed is:

1. A revolving door comprising:

a wall or a plurality of walls in which a plurality of openings for inlet and outlet of one or more persons or objects are provided; and a plurality of rotatable door wings that are configured to be rotatable around an imaginary central vertical axis in a passage area surrounded by said wall or said plurality of walls, wherein each of said plurality of rotatable door wings is provided with a slidable door wing part for extending or retracting said door wing of which it forms a part, and wherein each of said plurality of rotatable door wings substantially comprises a plurality of slidable door wing parts, wherein said plurality of slidable door wing parts of any single door wing are selectable to be placed in at least two positions, a first position wherein said plurality of slidable door wing parts are entirely adjacent or next to each other and wherein a plurality of edges of said plurality of slidable door wing parts are adjacent to said wall or said plurality of walls, and wherein said plurality of slidable door wing parts extend radially away from said wall or plurality of walls towards said imaginary central vertical axis, and a second position wherein said plurality of slidable door wing parts are entirely adjacent or next to each other and wherein said plurality of edges of said plurality of slidable door wing parts are adjacent to said imaginary central vertical axis, and wherein said plurality of slidable door wing parts extend radially away from said imaginary central vertical axis towards said wall or said plurality of walls, and wherein said plurality of slidable door wing parts of any single door wing are configured to be radially movable back-and-forth relative to and past said imaginary central vertical axis between opposite positions relative to said imaginary central vertical axis.

2. The revolving door according to claim 1, wherein said plurality of slidable door wing parts of any single door wing are configured to be disposed next to each other or substantially in each other's extended direction or in any intermediate relative position with respect to each other, and wherein each single slidable door wing part of any single door wing is positionable either closer to said wall than to said imaginary central vertical axis, or closer to said imaginary central vertical axis than to said wall.

3. The revolving door according to claim 1, configured such that when said plurality of rotatable door wings substantially extend from said imaginary central vertical axis up to said wall or said plurality of walls, a slidable door wing part of a door wing that approaches an opening or, when said plurality of rotatable door wings are stationary, a slidable door wing part of a door wing that is near to an opening, is arranged to retract away from said wall to give way from said passage area to said opening.

4. The revolving door according to claim 1, configured such that when said plurality of rotatable door wings rotate, said plurality of slidable door wing parts of each door wing are capable of simultaneously retracting away from said wall or plurality of walls.

5. The revolving door according to claim 1, further comprising a first sensor means, wherein the rotation of said door wings is interruptible depending on said first sensor means, wherein selected door wings of said revolving door are arranged to define a confined area delimited by said wall wherein access to or leaving said confined area is prevented, and wherein a door wing part of at least one of said door wings is operational to provide a conventional sliding door to enable passing said passage area.

6. The revolving door according to claim 1, further comprising a night door or a plurality of night doors to close off said opening or said plurality of openings, wherein said plurality of edges of said plurality of slidable door wing parts of said plurality of rotatable door wings are positionable against said night door or said plurality of night doors to support said night door or said plurality of night doors against the force of wind and against the forces of breaking and entry.

7. The revolving door according to claim 1, configured such that when said plurality of door wings are stationary, said plurality of edges of said plurality of slidable door wing parts are positionable against said wall or said plurality of walls to promote its draught resistance.

8. The revolving door according to claim 1, wherein said passage area further comprises a second sensor means and wherein said plurality of rotatable door wings are configured in an original position to substantially extend from said imaginary central vertical axis up to said wall or said plurality of walls, and wherein said slidable door wing part of said plurality of door wings that threatens to be obstructed by a passant in said passage area as observed by said second sensor means is arranged in a retracted position away from said wall so as to avoid obstruction with the passant and subsequently to resume said slidable door wing part's original position after said door wing is completely passed and the passant is observed by said second sensor means.

* * * * *